US005301596A

United States Patent [19]

Huey, Jr.

[11] Patent Number: 5,301,596

[45] Date of Patent: Apr. 12, 1994

[54] SHUTTLE PLATE BRAIDING MACHINE

[75] Inventor: Cecil O. Huey, Jr., Clemson, S.C.

[73] Assignee: Clemson University, Clemson, S.C.

[21] Appl. No.: 862,779

[22] Filed: Apr. 3, 1992

[51] Int. Cl.[5] ..... D04C 3/04

[52] U.S. Cl. ..... 87/8

[58] Field of Search ..... 87/5, 7, 8, 17, 28, 87/30, 31, 33, 38, 39, 40, 46, 50, 51, 55, 56, 57

[56] References Cited

U.S. PATENT DOCUMENTS

| | | | |
|---|---|---|---|
| 952,950 | 3/1910 | Schmidt | 87/38 |
| 3,426,804 | 2/1969 | Bluck . | |
| 4,312,261 | 1/1982 | Florentine . | |
| 4,615,256 | 10/1986 | Fukuta et al. . | |
| 4,621,560 | 11/1986 | Brown et al. . | |
| 4,719,837 | 1/1988 | McConnell et al. . | |
| 4,800,796 | 1/1989 | Vendramini . | |
| 4,881,444 | 11/1989 | Krauland . | |
| 4,885,973 | 12/1989 | Spain | 87/5 X |
| 4,898,067 | 2/1990 | Ashton et al. | 87/33 X |
| 4,916,997 | 4/1990 | Spain . | |
| 4,922,798 | 5/1990 | Ivsan et al. | 87/5 X |
| 4,936,186 | 6/1990 | Sekido et al. . | |
| 4,984,502 | 1/1991 | Spain et al. | 87/5 X |
| 5,067,525 | 11/1991 | Tsuzuki et al. | 87/33 X |

FOREIGN PATENT DOCUMENTS

| | | | |
|---|---|---|---|
| 2301696 | 7/1973 | Fed. Rep. of Germany | 87/33 |

OTHER PUBLICATIONS

"AYPEX: A New Method of Composite Reinforcement Braiding" by Richard D. Weiler. NASA Conference Publication 2420. Proceedings of a working-group meeting held at the David Taylor Naval Ship Research and Development Center, Annapolis, Md., Nov. 5-7, 1985.

"Magnaweave Process-From Fundamentals to Applications" by Robert A. Florentine. Presented at the Fiber Society Symposium on Fiber Reinforced Composites, Charlotte, N.C., Dec. 2-3, 1981.

"A New 3D Braid For Integrated Parts Manufacture and Improved Delamination Resistance-The 2-Step Process" by Peter Popper and Ronald McConnell. 32nd International SAMPE Symposium, Apr. 6-9, 1987.

"Analysis and Automation of Two-Step Braiding" by Guang-Wu Du, Peter Popper and Tsu-Wei Chou, Fiber Tex '88 Conference, Greenville, S.C., Sep. 13-15, 1988.

*Primary Examiner*—Joseph J. Hail, III

*Attorney, Agent, or Firm*—Dority & Manning

[57] ABSTRACT

A method and apparatus for moving yarn in a selected pattern to form a braided article. The apparatus includes a segmented grid of stationary support elements and a plurality of shuttles configured to carry yarn. The shuttles are supported for movement on the grid assembly and each shuttle includes a retractable plunger for engaging a reciprocating shuttle plate that moves below the grid assembly. Such engagement at selected times causes the shuttles to move about the grid assembly in a selected pattern to form a braided article of a particular geometry.

21 Claims, 8 Drawing Sheets

SHUTTLE PLATE BRAIDING MACHINE

This invention was made with Government support under Contract No. NCC1-128 awarded by NASA. The Government has certain rights in this invention.

BACKGROUND OF THE INVENTION

The present invention relates generally to a method and apparatus for moving yarn in a selected pattern, and more particularly to a method and apparatus for moving yarn in a selected pattern to generate braided articles of various configurations. The present invention improves upon weaving techniques currently known for generating complex forms such as the pre-form structures used in producing composite materials. Currently known three dimensional braiding devices are either limited in flexibility with respect to the braiding patterns obtainable, or obtain flexibility at the expense of complexity of the device. A number of known braiding device produce braid patterns that are intrinsic to the particular device being used, and do not allow for various braiding patterns on a single device. Other known braiding methods allow flexibility in braiding patterns, but are extremely complex in operation, such complexity making practical implementation and operation difficult and expensive.

SUMMARY OF THE INVENTION

The present invention recognizes and addresses the foregoing disadvantages, and others of prior art constructions and methods.

Accordingly, it is an object of the present invention to provide an improved apparatus for moving yarn in a selected pattern.

It is another object of the present invention to provide an improved method of moving yarn in a selected pattern.

It is a further object of the present invention to provide a method and apparatus capable of producing a variety of structural shapes of braided articles.

It is another object of the present invention to provide a braiding method and apparatus that utilizes a minimal number of actively controlled devices.

It is a further object of the present invention to provide a method and apparatus for braiding wherein the actively controlled actions are mechanically uncomplicated.

These and other objects and features of the present invention are achieved by providing an apparatus for moving yarn in a selected pattern to form a braided article, the apparatus including a grid assembly of stationary support elements and a plurality of shuttles configured to carry yarn, the shuttles being supported for movement on the grid assembly, and each shuttle including means for selectively engaging a movable shuttle plate. The apparatus further includes a movable shuttle plate located below the grid assembly and adapted to impart motion to the shuttles when the shuttles engage the shuttle plate.

The apparatus also includes means for driving the shuttle plate, and means for controlling the selective engagement means so as to cause engagement between the selective engagement means and the shuttle plate to cause the shuttles to move in a controlled pattern, whereby when said shuttles carry yarn and are moved in a controlled pattern, a braided article of predetermined geometry will be formed.

The means for selectively engaging the shuttle plate may include a solenoid actuated retractable plunger, and the shuttle plate may define a plurality of holes therein for receipt of the retractable plunger when it is actuated. In addition, the means for driving the shuttle plate causes the shuttle plate to reciprocate in a horizontal plane along two orthogonal axes, the shuttle plate moving in only a single direction at any particular time.

The objects of the present invention are also accomplished by the method of moving yarn in a selected pattern to form a braided article comprising the steps of, providing a grid assembly of stationary support elements, supporting a plurality of yarn carrying shuttles with retractable plungers on the grid assembly, reciprocating a movable shuttle plate below the grid assembly in a plane along two orthogonal axes, and selectively and independently actuating the plungers to engage the shuttle plate as it reciprocates to cause the shuttles to move in a selected pattern along the grid assembly to thereby form a braided article of predetermined geometry.

The apparatus and method generate braid patterns by moving individual yarn ends, selectively and independently, from point to point above the grid assembly. Independent control of the motion of each shuttle is achieved through computer control, permitting shuttle movements to be accomplished as needed without requiring physical adjustments to the basic machine. This independent control permits the generation of any three-dimensional braid pattern that can be formed by a combination of yarn movements. The present invention enables enhanced control of fiber orientation within braided articles, facilitating optimum design of parts that must be subjected to complex loads or that have complex shapes.

Other objects, features and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying figures, in which.

Figure 1:
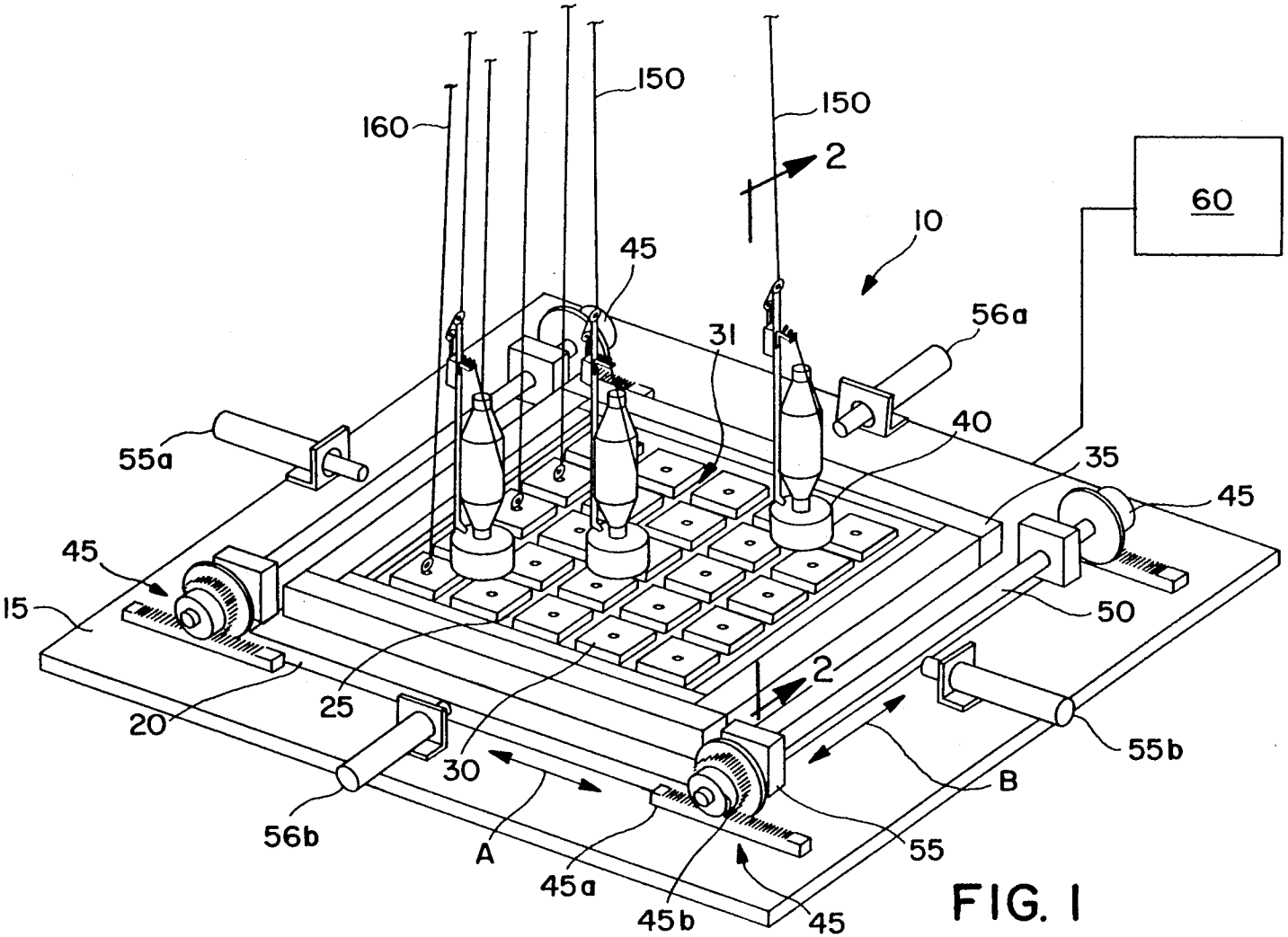
FIG. 1 is a perspective view of an apparatus in accordance with the present invention.

Repeat use of reference characters in the present specification and drawings is intended to represent same or analogous features or elements of the invention.

DETAILED DESCRIPTION OF PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary construction.

Referring to FIG. 1, an apparatus for moving yarn in accordance with the present invention is illustrated generally at 10. The apparatus includes a stationary support base 15, a movable shuttle plate 20 located above the base 15, and a stationary grid assembly 25. Grid assembly 25 includes a plurality of stationary support elements 30 oriented so as to form movement channels 31 between any given pair of stationary support elements 30. In a preferred embodiment, each stationary support element 30 is square and the grid assembly 25 is surrounded by a frame 35.

While the apparatus of the present invention is illustrated with a grid assembly comprising a $5\times5$ matrix of stationary support elements 30, it should be understood by one skilled in the art that this is for illustrative purposes only. It is within the scope of the present invention to have a grid of any desired size with any number of stationary support elements 30, depending on the size and shape of the article to be produced. It is also within the scope of the present invention to utilize a plurality of apparatus 10 located proximate one another to produce an article of desired size or shape.

The apparatus in accordance with the present invention also includes shuttles 40 configured to carry yarn. Shuttles 40 are supported for movement on grid assembly 25 along the movement channels 31 formed between the individual stationary support elements 30. While three shuttles 40 are illustrated in FIG. 1, it should be understood that the number of shuttles 40 will vary depending on the number of braiding yarns being utilized to form the braided article. Therefore, any number of shuttles 40 can be utilized on a particular grid assembly to form a particular product. The final braided article (not illustrated) is formed above the shuttles where yarn 150 extends.

As illustrated in FIG. 1, movable shuttle plate 20 may be supported for movement with respect to base 15 and grid assembly 25 by rack and pinion mechanisms 45. Rack portions 45*a* are attached to base 15 and pinion portions 45*b* are operatively connected to shuttle plate 20. These rack and pinion mechanisms 45 allow movement of the shuttle plate 20 back and forth in the direction indicated by arrow A. Movement of shuttle plate 20 back and forth in the direction indicated by arrow B is provided by guide blocks 55 which ride on guide rods 50. Guide blocks 55 are operatively connected to shuttle plate 20, and guide blocks 55 are fixed against movement in the direction of arrow B. While a rack and pinion and guide block mechanism is illustrated for supporting shuttle plate 20, any mechanism that maintains shuttle plate 20 in alignment with grid assembly 25 could be utilized. Use of the rack and pinion and guide block mechanism insures that shuttle plate 20 reciprocates smoothly without binding when in operation.

Means for driving shuttle plate 20 are also provided. In a preferred embodiment, the means for driving shuttle plate 20 includes a first pair of fluid actuated cylinders 55*a* and 55*b* and a second pair of fluid actuated cylinders 56*a* and 56*b*. These fluid actuated cylinders cooperate to provide reciprocating movement to the shuttle plate 20 in a horizontal plane along two orthogonal axes indicated by lines A and B, the shuttle plate moving only in a single direction at any particular time. As is apparent, when cylinder 55*a* is actuated, shuttle plate 20 will be moved in the direction of arrow A toward cylinder 55*b*. When 55*b* is actuated, shuttle plate 20 will be moved back in the direction of arrow A toward cylinder 55*a*. Cylinders 56*a* and 56*b* operate in a similar manner in the direction of arrow B. Actuation of all fluid actuated cylinders may be controlled by a central processing unit 60. In another embodiment, the shuttle plate 20 may be caused to reciprocate at a given frequency without control by the central processing unit 60.

As illustrated in FIG. 1, central processing unit 60 also controls the actuation of yarn carrying shuttles. Central processing unit 60 can be programmed to selectively actuate shuttles 40 to engage and disengage shuttle plate 20 as it reciprocates. Such selected actuation will cause shuttles 40 to move about grid assembly 25 in a selected pattern to generate the desired braided article. The pattern of movement of the shuttles is specific to the pattern programmed in the central processing unit 60.

Figure 2:
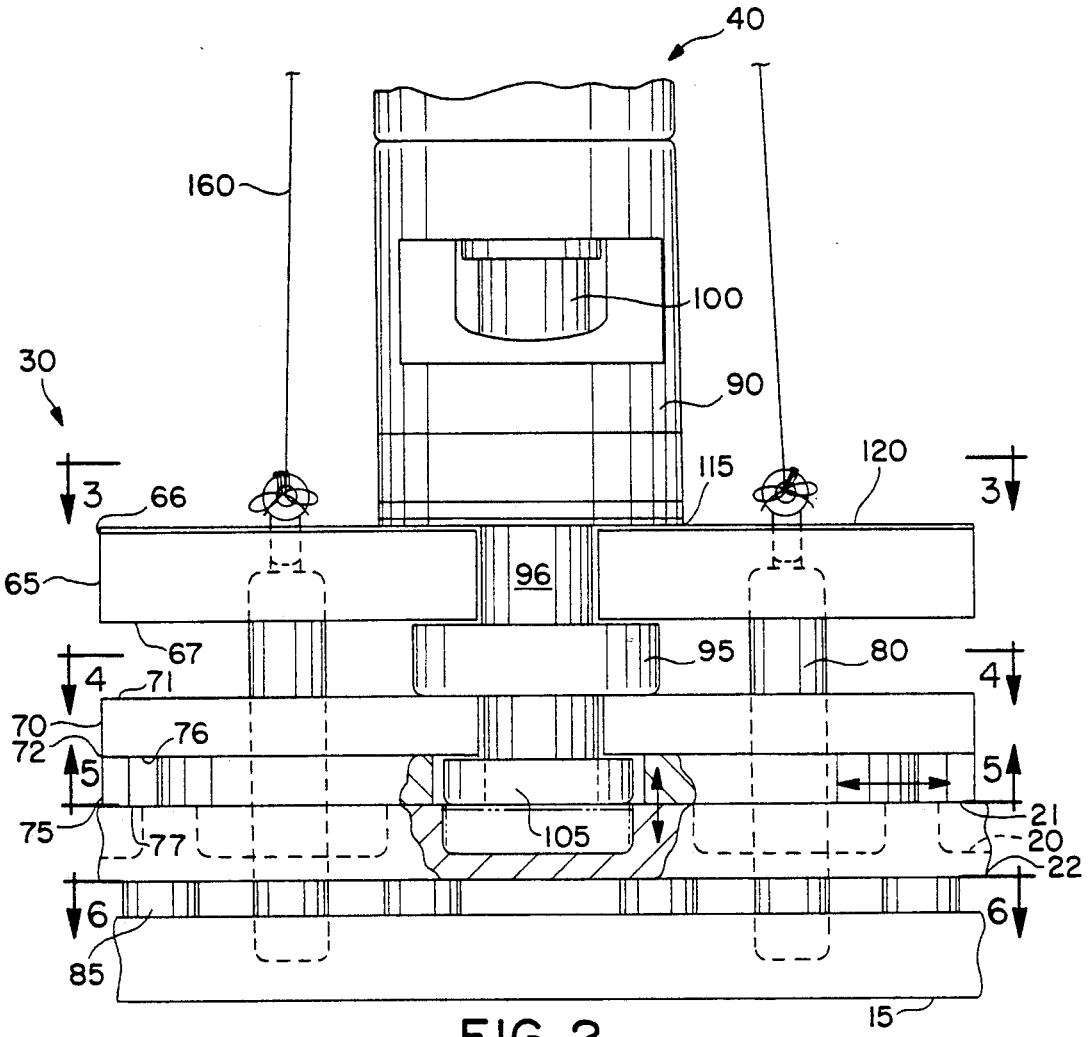
FIG. 2 is a sectional view of FIG. 1 taken along lines 2—2.

Referring to FIG. 2, stationary support elements 30 that make up the grid assembly 25 will be described in more detail. Each stationary support element 30 includes an upper support element plate 65 with an upper surface 66 and a lower surface 67. Each stationary support element 30 also includes an intermediate support element plate 70 with an upper surface 71 and a lower surface 72. Further, each stationary support element 30 includes a scalloped or contoured lower support element plate 75 with an upper surface 76 and a lower surface 77. Lower support element plate 75 and intermediate support element plate 70 may be unitary or integral.

Each stationary support element 30 is connected to base plate 15 through support shaft 80. As illustrated in FIG. 2, upper support element plate 65 is spaced apart along the axis of support shaft 80 from intermediate support element plate 70 for receipt therebetween of a portion of a yarn carrying shuttle 40. Shuttle plate 20 includes an upper surface 21 and a lower surface 22. Lower surface 22 is slidingly supported on friction reducing spacers 85 on base plate 15. This allows shuttle plate 20 to reciprocate with respect to base plate 15 and grid assembly 25.

Referring to FIGS. 1 and 2, each yarn carrying shuttle 40 includes a base 90 connected by a connecting portion 96 to a guide portion 95 that is spaced from and extends below base portion 90. Each shuttle 40 also includes a solenoid actuated plunger 100 that extends below base 90 and guide portion 95. Plunger 100 includes catch button portion 105 integral therewith at its lower end. Each shuttle 40 also includes onboard control circuitry 110 (FIG. 7) which cooperates with central processing unit 60 (FIG. 1) to selectively control the actuation of solenoid plunger 100 as will be discussed below. A lower surface of base 90 of shuttle 40 includes a conductive surface 115 that interacts with a conductive surface 120 on the upper support element plate 65 so that power and control signals can be transferred to the onboard control circuit 110 from beneath the grid assembly 25. A complete circuit is formed by elements 95 and 96 contacting portions of support elements 70, 75.

In one embodiment, continuous power is provided to an activated shuttle to maintain the plunger extended. It is also within the scope of the present invention to utilize a mechanical latching of the plunger with only momentary current required to engage the latch, thus reducing the amount of current necessary to operate the shuttles. In addition, it is within the scope of the present invention to transmit power and control signals to shuttles 40 by any effective means, such as, for example, using wireless transmissions to control shuttles 40.

As illustrated in FIGS. 1 and 2, stationary support elements 30 are located so as to form movement channels 31 therebetween through which yarn carrying shuttles 40 travel when central processing unit 60 signals onboard control circuit 110 to cause actuation of plunger 100 on a particular shuttle. When this occurs, plunger 100 is extended to engage the reciprocating shuttle plate 20 for movement until the plunger is retracted. As best illustrated in FIG. 2, guide portions 95 of shuttles 40 extend between upper support element plates 65 and intermediate support element plates 70 to guide shuttles 40 in a stable manner during movement.

Figure 3:
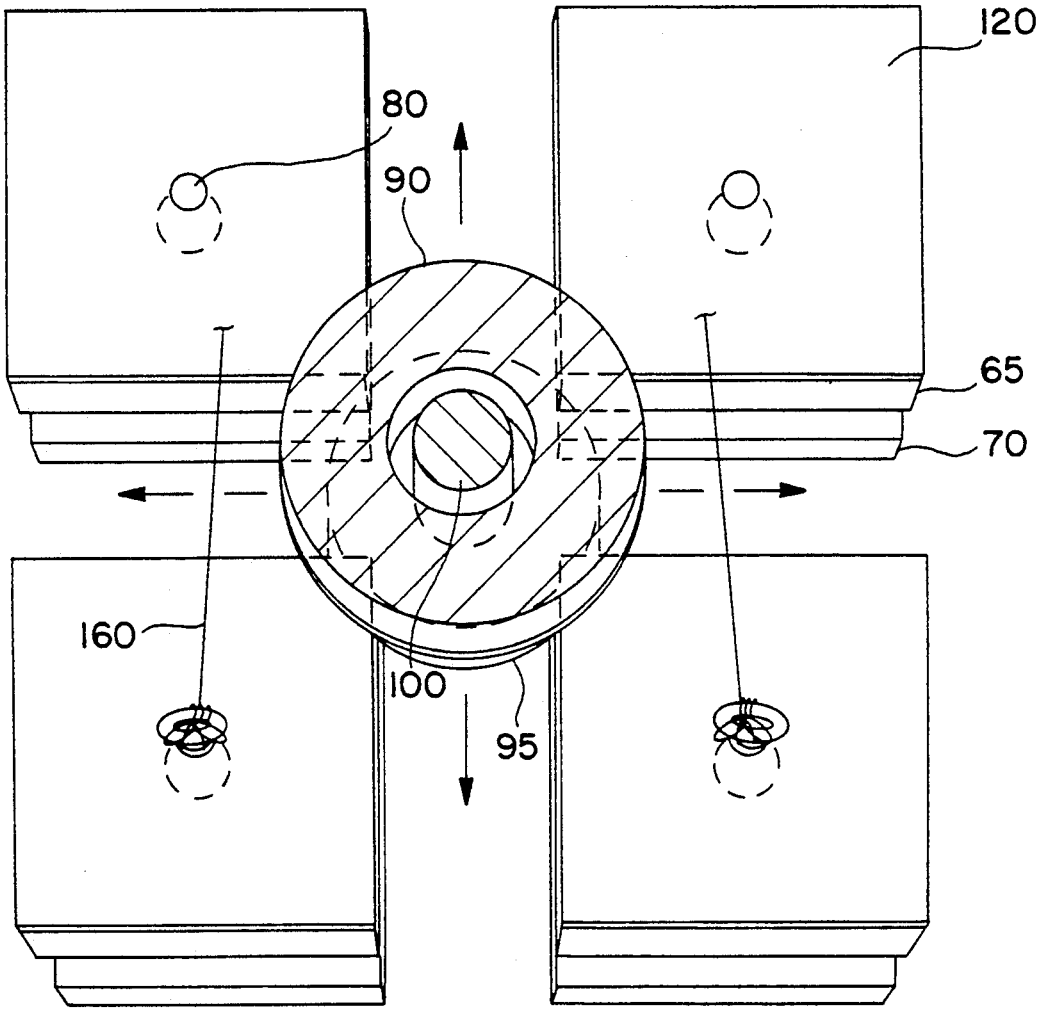
FIG. 3 is a sectional view of FIG. 2 taken along lines 3—3.

As illustrated in FIGS. 2 and 3, each shuttle 40 is maintained in grid assembly 25 by its base 90 riding on the upper support element plate upper surface 66 and guide portion 95 of shuttle 40 being located between upper support element plate 65 and intermediate support element plate 70. Each individual shuttle 40 can be caused to move in directions as indicated by the arrows in FIG. 3 so as to be capable of being moved to any chosen position on the grid assembly 25.

Figure 4:
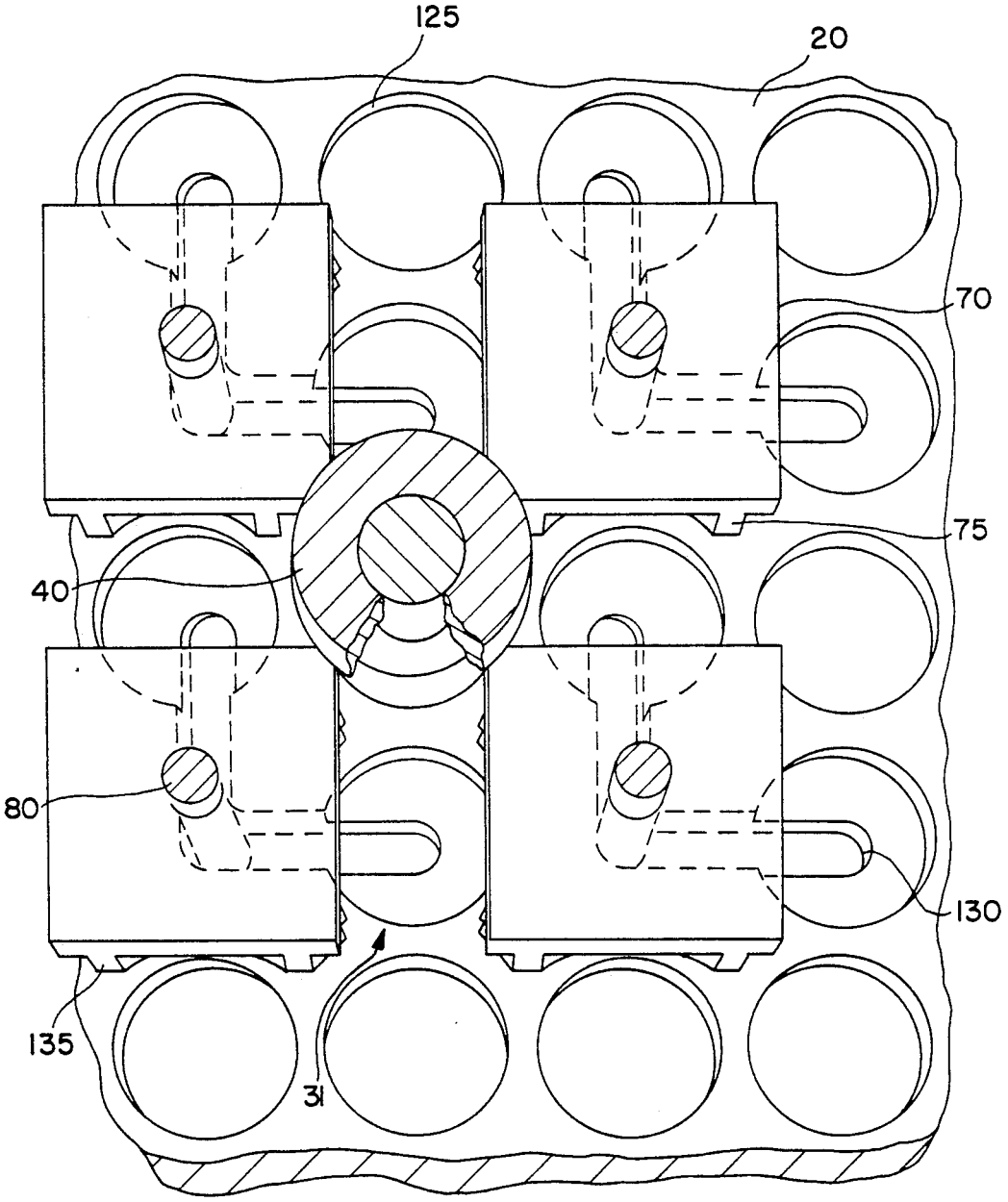
FIG. 4 is a sectional view of FIG. 2 taken along lines 4—4.

As illustrated in FIG. 4, shuttle plate 20 includes a plurality of shuttle plate holes 125 and a plurality of shuttle plate slots 130. In a preferred embodiment, slots 130 are L-shaped so as to guide shuttle plate 20 for movement along two perpendicular axes as indicated by arrows A and B in FIG. 1. Received through slots 130 are stationary support element support shafts 80. Slots 130 allow shuttle plate 20 to reciprocate by allowing support shafts 80 to move therein. In a preferred embodiment, the length of each leg of the L-shaped slot is approximately equal to one-half the distance between adjacent support members 80. The size of each hole 125 must be large enough to accommodate plunger buttons 105.

In operation, shuttle plate 20 reciprocates below grid assembly 25, along one axis at a time (axes A and B in FIG. 1), and does not contact shuttles 40 when shuttle plungers 100 are retracted. When any individual shuttle plunger 100 is activated, its plunger 100 extends down to move plunger catch button 105 into engagement with shuttle plate holes 125 to thereby cause shuttle 40 to move in the direction that shuttle plate 20 is moving when engaged. The desired movements of the braiding yarns 150 are obtained by selectively commanding individual shuttles 40 to engage the shuttle plate as it moves. When the activated shuttle has moved or indexed with the shuttle plate 40, it is deactivated so that it is not returned to its previous location when the shuttle plate moves back in the opposite direction. This activation-deactivation sequence is continued as controlled by the central processing unit to move the shuttles in the desired pattern to cause the yarns 150 being carried thereabove to be braided. Shuttle plate 20 may be actively controlled by central processing unit 60 so as to obtain the most efficient movement of the shuttles. For example, shuttle plate 20 could be caused to reciprocate more than once along the A axis before again moving along the B axis.

Figure 5:
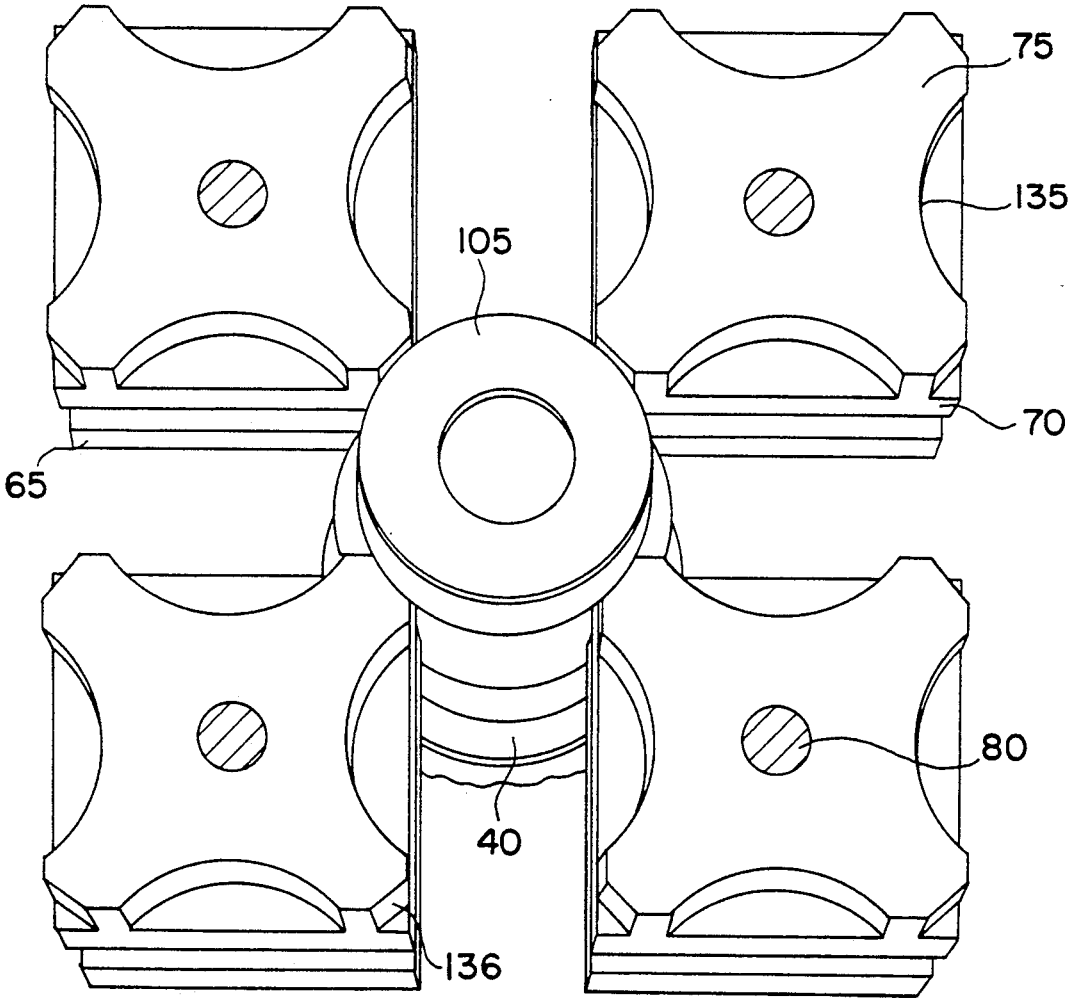
FIG. 5 is a sectional view of FIG. 2 taken along lines 5—5.

As best illustrated in FIGS. 2, 4 and 5, when plunger 100 is retracted, plunger catch button 105 is located in substantially the same plane as lower support element plate 75. Plunger catch button 105 is preferably substantially circular and matingly engages with contoured portions 135 or 136 of lower support element plate 75. This engagement prevents the shuttle plate from causing unwanted movement of any shuttle 40 because of frictional contact or otherwise when that shuttle's plunger 100 is retracted.

Figure 6:
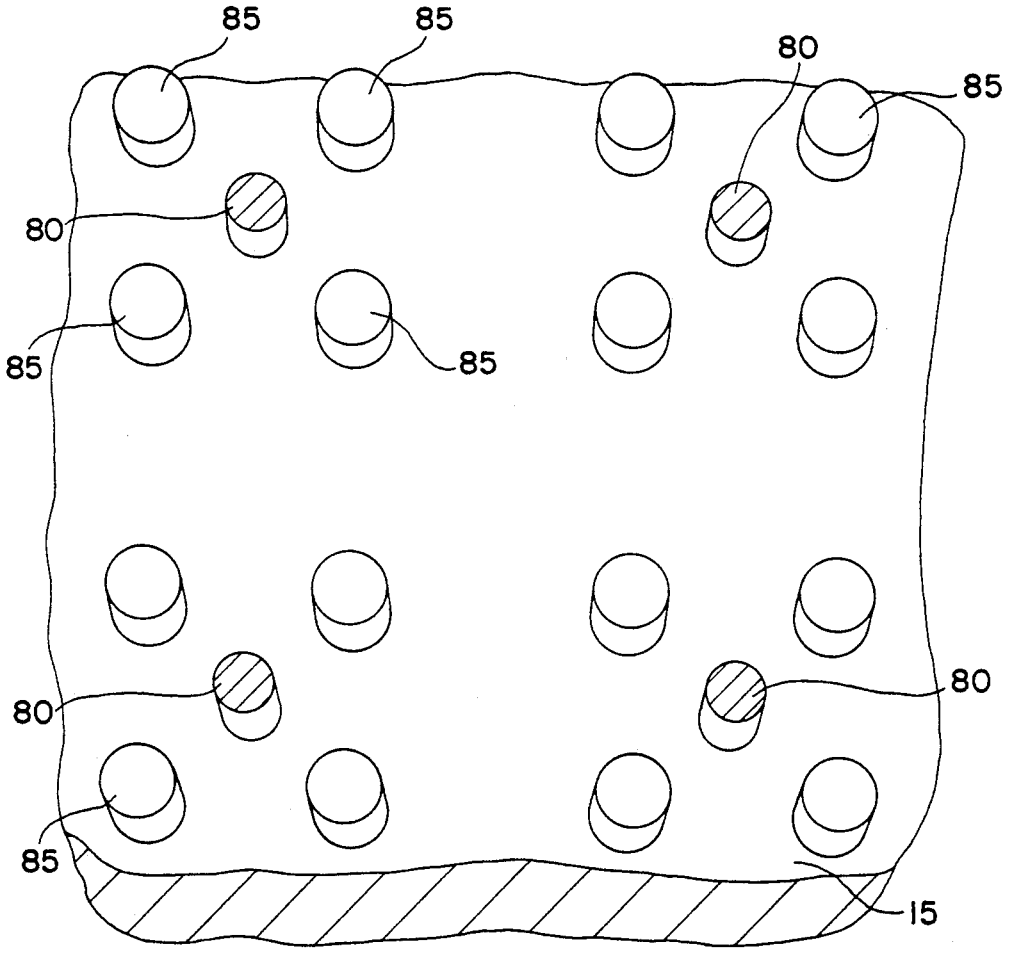
FIG. 6 is a sectional view of FIG. 2 taken along lines 6—6.

As illustrated in FIG. 6, stationary support element support shafts 80 are rigidly attached to base plate 15 and friction reducing spacers 85 are located between base plate 15 and shuttle plate 20 so that shuttle plate 20 can reciprocate with minimal friction resistance. It should be appreciated that friction reducing spacers 85 could be attached to either one of shuttle plate 20 or base 15. In addition, it should be appreciated that shuttle plate 20 could be suspended for movement above base plate 15 without actual physical contact such as by use of magnetic levitation or a bed of air jets.

Figure 7:
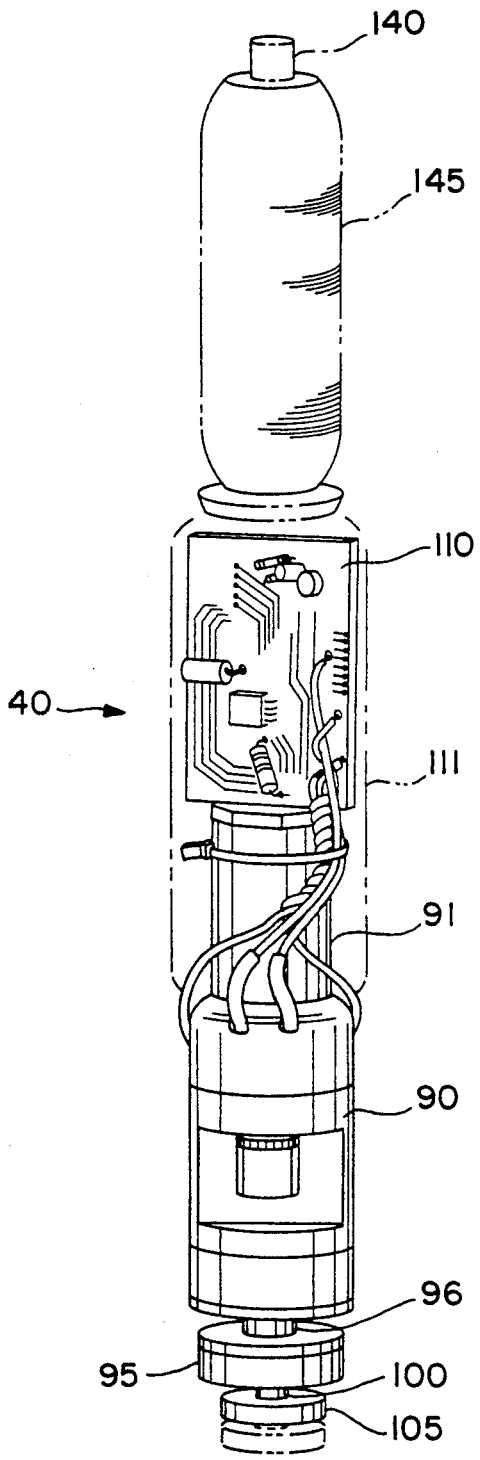
FIG. 7 is a perspective view partially in section of an embodiment of a shuttle in accordance with the present invention.

Referring to FIG. 7, a shuttle 40 in accordance with one embodiment of the present invention is illustrated in detail. Shuttle 40 includes a base 90 and a guide portion 95 connected by a connecting portion 96. Shuttle 40 further includes a plunger 100 and a plunger catch button 105 that is adapted to engage shuttle plate holes 125 (illustrated in FIG. 4). Shuttle 40 also includes a solenoid 91 and an onboard control circuit 110 maintained in a casing 111. Supported atop casing 111 is a yarn bobbin core 140 supporting a bobbin of yarn 145.

Figure 8:
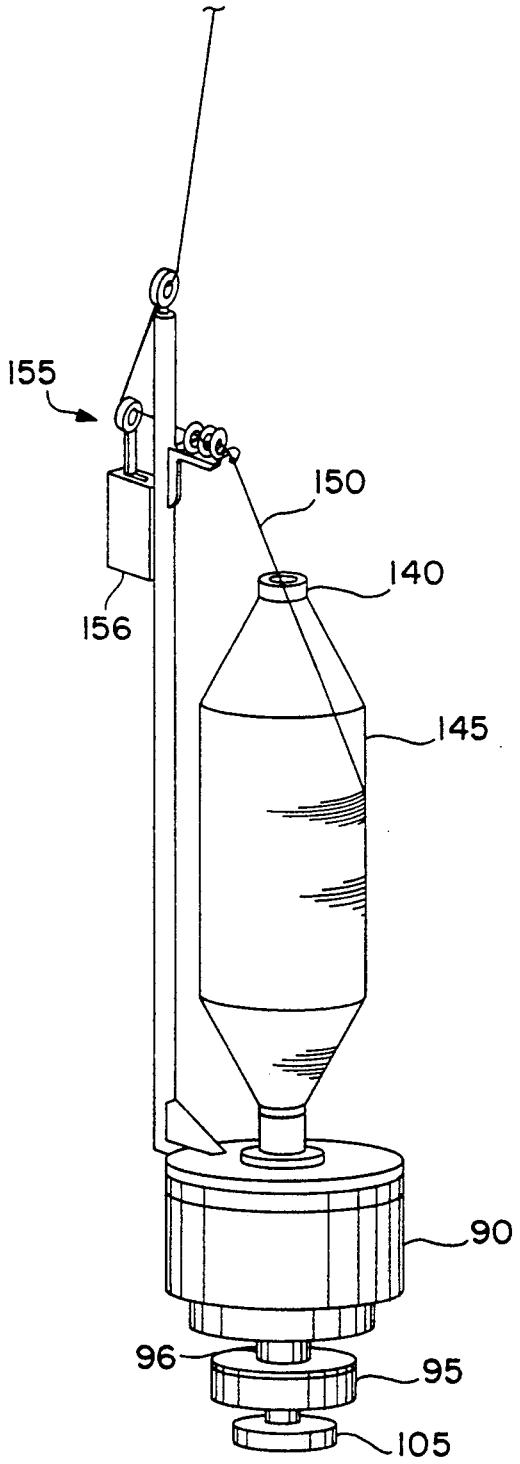
FIG. 8 is a perspective view of another embodiment of a shuttle in accordance with the present invention.

Referring to FIG. 8, another embodiment of a shuttle 40 is illustrated. The shuttle 40 illustrated in FIG. 8 includes a plunger 105, guide portion 95 connected to and spaced apart from shuttle base 90. In this embodiment, shuttle base 90 incorporates solenoid 91 and onboard control circuit 110 therein. Supported on shuttle base 90 is a bobbin core 140 and a yarn bobbin 145. Braiding yarn 150 is illustrated extending from yarn bobbin 145 to tension control device 155 which includes a conventional mechanism for maintaining a desired tension in yarn 150, irrespective of the position shuttle 40 is at on grid assembly 25. The conventional mechanism for maintaining a desired tension in yarn 150 may include a weight 156 operatively connected to the yarn to control the tension of each particular braiding yarn 150 and take up unwanted slack in the yarn during braiding.

Each onboard control circuit 110 is preferably an address-programmable receiver/transmitter circuit. The selective control of the plunger 100 on each shuttle is obtained by directing control signals from the central processing unit 60 to specific addresses, with each shuttle 40 representing one address. By this means, each shuttle can be selectively actuated and deactivated in a desired sequence to engage the shuttle plate 20 to thereby move the shuttles in the desired pattern. The shuttles may also communicate with the central processing unit to relay stop signals, to verify instructions, to report a yarn breakage, or the like. The move commands are transmitted directly to each shuttle and the controlled action is an on/off command to activate the solenoid on each shuttle.

Figure 9D:
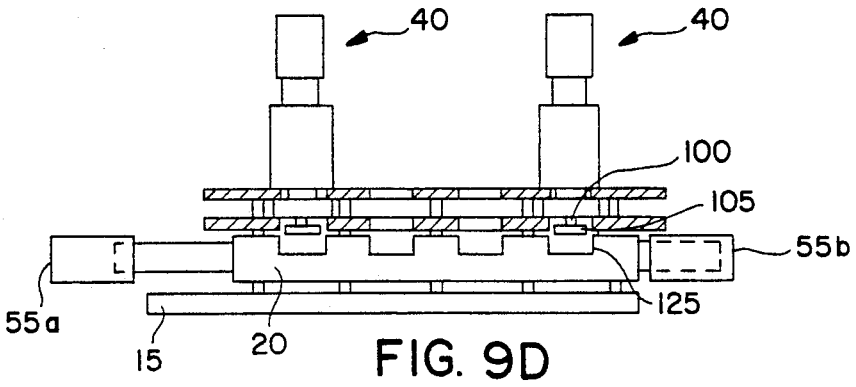
FIGS. 9A-9D are a sequential schematic representative of the shuttle plate operation illustrating movement of a single shuttle along one axis.
Figure 9A:
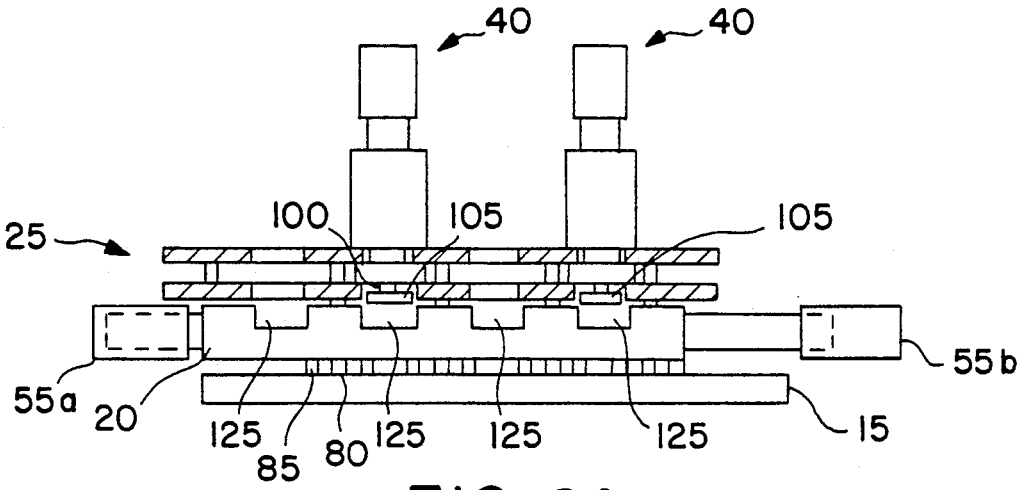
Figure 9B:
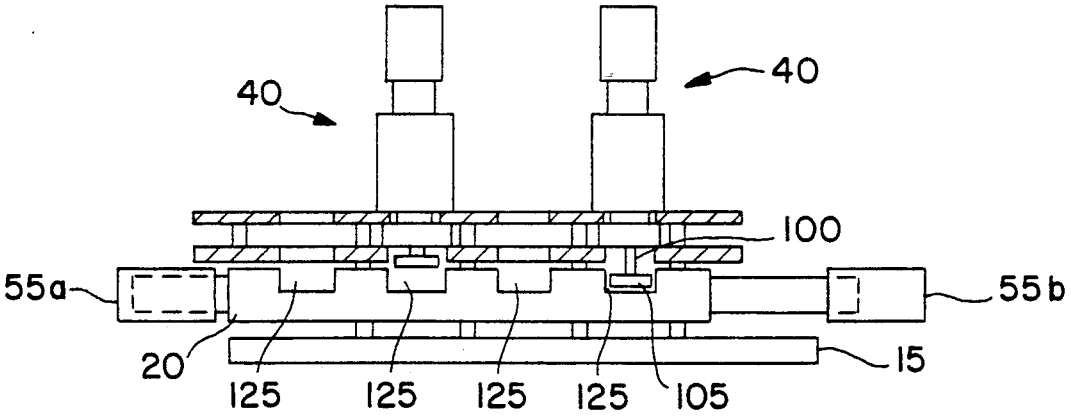
Figure 9C:
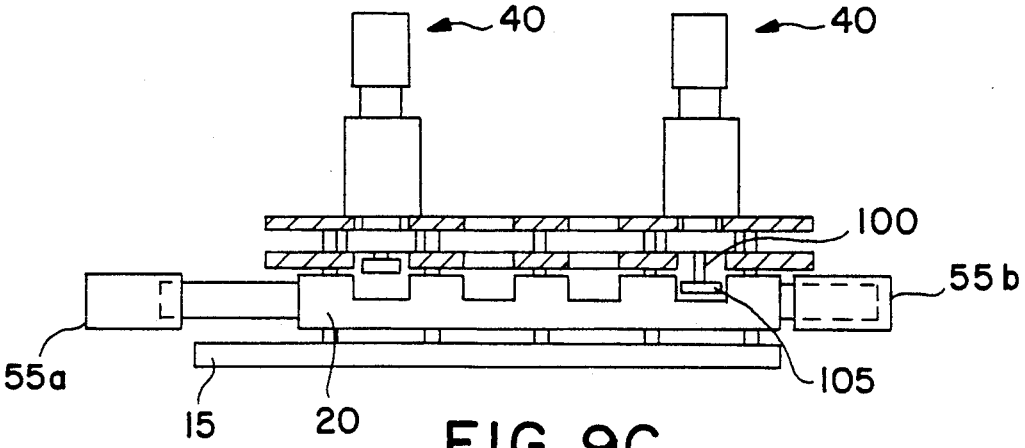

Referring to FIGS. 9A through 9D, operation of the present invention will be described. FIG. 9A illustrates two shuttles 40 supported on grid assembly 25 above shuttle plate 20. Both shuttles have their plungers 100 in the retracted position. Referring to FIG. 9B, the position of the right side shuttle 40 is illustrated where central processing unit 60 has signalled onboard control circuit 110 on shuttle 40 to cause plunger 100 to be actuated. When plunger 100 is actuated, it extends plunger button 105 down into shuttle plate hole 125 for engagement therewith. Referring to FIG. 9C, fluid actuated cylinder 55*a* moves shuttle plate 125 toward the right in FIG. 9C. Since plunger button 105 is received in shuttle plate hole 125, shuttle 40 will be moved to the right the same distance that the shuttle plate is moved by fluid actuated cylinder 55*a*. As illustrated in FIG. 9D, the central processing unit then causes plunger 100 to be retracted prior to the shuttle plate 20 reciprocating back in the left direction in FIG. 9D. While FIGS. 9A through D only illustrate movement of one shuttle 40 and in a single direction, it should be readily appreciated that selective actuation of plungers 100 for a number of shuttles will cause selective engagement with the shuttle plate 20, which is reciprocating in a horizontal plane about the orthogonal axes, the shuttle plate moving only in a single direction at any particular time, to therefore move any particular shuttle 40 by a series of steps to any desired location on grid assembly 25. Therefore, the central processing unit can be programmed to cause any number of shuttles 40 to move in any predetermined pattern desired by a series of address specific on/off commands to the shuttles so as to produce a desired braided article. Since the central processing unit may also control the movement of shuttle plate 20, the central processing unit can be programmed to actuate the desired plungers when the shuttle plate holes are in the proper location for the desired action. Of course, any method of insuring the plunger buttons engage the shuttle plate holes properly could be utilized.

As illustrated in FIGS. 1, 2 and 3, stationary axial non-braiding yarns 160 can be located at desired positions on grid assembly 25 to introduce axial yarns into the braided article without affecting either the control or mechanical operation of the apparatus. In a preferred embodiment, support members 80 may be hollow to receive axial non-braided yarns from beneath base 15 from a spool or the like. In addition, any number of yarn carrying shuttles 40 can be utilized and any type of yarn that can be braided can be utilized. Further, use of the words above and below in the present specification are intended to express relative relationships of the elements within the apparatus. It should be apparent that the entire apparatus could be inverted or operated on its side, in which case an element described as above another would then be below it.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to be limitative of the invention so further described in such appended claims.

What is claimed is:

1. An apparatus for moving yarn in a selected pattern to form a braided article, said apparatus comprising:

a grid assembly of stationary support elements;

a plurality of shuttles configured to carry yarn, said shuttles being supported for movement on said grid assembly, each said shuttle including means for selectively engaging a movable shuttle plate;

a unitary movable shuttle plate located below said grid assembly for imparting motion to each of said shuttles, and capable of moving said shuttles through the entire grid when said shuttles intermittently engage said shuttle plate;

means for driving said shuttle plate; and means for controlling said selective engagement means so as to cause engagement between said selective engagement means and said shuttle plate to cause said shuttles to move in a controlled pattern whereby when said shuttles carry yarn and are moved in said controlled pattern, a braided article of predetermined geometry will be formed.

2. An apparatus as set forth in claim 1 above, wherein each said shuttle includes a yarn bobbin thereon.

3. An apparatus as set forth in claim 2 above, wherein each said bobbin includes a yarn tension control device thereon.

4. An apparatus as set forth in claim 1 above, wherein each said stationary support element includes an upper support element plate, an intermediate support element plate spaced below said upper support element plate, and a lower support element plate adjacent said intermediate support element plate.

5. An apparatus as set forth in claim 4 above, wherein said intermediate support element plate and said lower support element plate are unitary.

6. An apparatus as set forth in claim 1 above, wherein said means for driving include fluid actuated cylinders in operative communication with said shuttle plate.

7. An apparatus for moving yarn in a selected pattern to form a braided article, said apparatus comprising:

a grid assembly of stationary support elements;

a plurality of shuttles configured to carry yarn, said shuttles being supported for movement on said grid assembly, each said shuttle including a retractable plunger for selectively engaging a movable shuttle plate;

a movable shuttle plate located below said grid assembly and adapted to impart motion to said shuttles when said shuttles engage said shuttle plate;

means for driving said shuttle plate; and means for controlling said retractable plunger so as to cause selective engagement between said plunger and said shuttle plate to cause said shuttles to move in a controlled pattern whereby when said shuttles carry yarn and are moved in said controlled pattern, a braided article of predetermined geometry will be formed.

8. An apparatus as set forth in claim 7 above, wherein said plunger is solenoid actuated.

9. An apparatus as set forth in claim 7 above, wherein said movable shuttle plate defines a plurality of holes therein for receipt of said retractable plunger when said plunger is selectively actuated.

10. An apparatus as set forth in claim 9 above, wherein each said yarn carrying shuttle includes a base portion and a guide portion, said guide portion being interconnected with said base portion by an interconnecting portion, a lower surface of said base portion being spaced from an upper surface of said guide portion a distance slightly larger than the height of said upper support plate element, said guide portion being partially received between said upper support element plate and said intermediate support element plate for guided movement about said grid assembly.

11. An apparatus for moving yarn in a selected pattern to form a braided article, said apparatus comprising:

a grid assembly of stationary support elements;

a plurality of shuttles configured to carry yarn, said shuttles being supported for movement on said grid assembly, each said shuttle including means for selectively engaging a movable shuttle plate;

a movable shuttle plate located below said grid assembly and adapted to impart motion to said shuttles when said shuttles engage said shuttle plate;

means for driving said shuttle plate to reciprocate in a horizontal plane along two orthogonal axes, the shuttle plate moving only in a single direction at any particular time; and means for controlling said selective engagement means so as to cause engagement between said selective engagement means and said shuttle plate to cause said shuttles to move in a controlled pattern whereby when said shuttles carry yarn and are moved in said controlled pattern, a braided article of predetermined geometry will be formed.

12. An apparatus for moving yarn in a selected pattern to form a braided article, said apparatus comprising:

a grid assembly of stationary support elements wherein each said stationary support element includes an upper support element plate, an intermediate support element plate spaced below said upper support element plate, and a lower support element plate adjacent said intermediate support element plate;

a plurality of shuttles configured to carry yarn, said shuttles being supported for movement on said grid assembly, each said shuttle including means for selectively engaging a movable shuttle plate;

a control circuit on each said shuttle for controlling the actuation of the selective engagement means;

a movable shuttle plate located below said grid assembly and adapted to impart motion to said shuttles when said shuttles engage said shuttle plate;

means for driving said shuttle plate; and means for controlling said selective engagement means so as to cause engagement between said selective engagement means and said shuttle plate to cause said shuttles to move in a controlled pattern whereby when said shuttles carry yarn and are moved in said controlled pattern, a braided article of predetermined geometry will be formed.

13. An apparatus as set forth in claim 12 above, wherein said upper support element plate includes an electrically conductive surface thereon and said base portion of said shuttle includes an electrically conductive surface thereon adapted to be in operative contact with said upper support element plate conductive surface, whereby power and control signals can be conveyed to the control circuit of each shuttle.

14. An apparatus for moving yarn in a selected pattern to form a braided article, said apparatus comprising:

a stationary base;

a grid assembly of stationary support elements, each said support element including a support member fixedly connecting said support elements to said base;

a plurality of shuttles configured to carry yarn, said shuttles being supported for guided movement on said grid assembly, each said shuttle including a retractable plunger for selectively engaging a movable shuttle plate;

a movable shuttle plate located between said grid assembly and said stationary base and adapted to impart motion to said shuttles when said retractable plungers engage said shuttle plate, said shuttle plate defining a plurality of slots for receipt of said support members therethrough, said slots being configured to guide said shuttle plate in a plane along two orthogonal axes, said shuttle plate further defining a plurality of holes therein for engagement with said retractable plungers when said plungers are actuated to obtain the desired movement of said shuttles for the selected pattern;

means for driving said shuttle plate in reciprocating motion in a plane along two orthogonal axes, the shuttle plate moving only in a single direction at any particular time; and means for controlling said retractable plunger so as to cause selective engagement between each said plunger and one said shuttle plate hole to cause said shuttle to move in a controlled pattern whereby when yarn is being carried on said shuttles and when said shuttles are moved in said controlled pattern, a braided article of predetermined geometry will be formed.

15. An apparatus as set forth in claim 14 above, wherein each said shuttle includes a yarn bobbin thereon.

16. An apparatus as set forth in claim 14 above, wherein each said stationary support element includes an upper support element plate, an intermediate support element plate spaced below said upper support element plate, and a lower support element plate adjacent said intermediate support element plate.

17. An apparatus as set forth in claim 16 above, wherein each said yarn carrying shuttle includes a base portion and a guide portion, said guide portion being interconnected with said base portion by an interconnecting portion, a lower surface of said base portion being spaced from an upper surface of said guide portion a distance slightly larger than the height of said upper support plate element, said guide portion being partially received between said upper support element plate and said intermediate support element plate for guided movement about said grid assembly.

18. An apparatus as set forth in claim 17 above, wherein each of said plungers includes a button thereon for engaging said shuttle plate holes, and said lower support element plates have semi-circular contours about their periphery to receive said buttons when said plungers are retracted to prevent said shuttles from moving when they are not engaged with the shuttle plate.

19. A method of moving yarn in a selected pattern to form a braided article, the method comprising the steps of:

providing a grid assembly of stationary support elements;

supporting a plurality of yarn carrying shuttles with retractable plungers on said grid assembly;

reciprocating a movable shuttle plate below said grid assembly in a plane along two orthogonal axes;

selectively and independently actuating said plungers to engage said shuttle plate as it reciprocates to cause said shuttles to move in a selected pattern along the grid assembly to thereby form a braided article of predetermined geometry.

20. The method as set forth in claim 19 above, and further including the step of fixedly attaching at least one axial yarn on the grid assembly to be incorporated into the braided article.

21. The method as set forth in claim 19 above, and further including the step of providing tension control to the yarn carried on the shuttles so that a desired tension will be maintained as the shuttles move across the grid assembly.

* * * * *